US006143241A

United States Patent [19]

Hajaligol et al.

[11] Patent Number: 6,143,241

[45] Date of Patent: Nov. 7, 2000

[54] METHOD OF MANUFACTURING METALLIC PRODUCTS SUCH AS SHEET BY COLD WORKING AND FLASH ANNEALING

[75] Inventors: Mohammad R. Hajaligol, Midlothian, Va.; Vinod K. Sikka, Oak Ridge, Tenn.

[73] Assignee: Chrysalis Technologies, Incorporated, Richmond, Va.

[21] Appl. No.: 09/247,065

[22] Filed: Feb. 9, 1999

[51] Int. Cl.[7] ..... B22F 3/24

[52] U.S. Cl. ..... 419/31; 419/28; 419/29; 419/43; 148/514; 148/557; 148/688; 148/695

[58] Field of Search ..... 419/28, 29, 31, 419/43; 148/514, 557, 688, 671, 677, 695

[56] References Cited

U.S. PATENT DOCUMENTS

| | | | |
|---|---|---|---|
| 1,550,508 | 8/1925 | Cooper . | |
| 1,990,650 | 2/1935 | Jaeger | 75/1 |
| 2,768,915 | 10/1956 | Nachman et al. | 148/2 |
| 2,889,224 | 6/1959 | Evans et al. | 74/214 |
| 3,026,197 | 3/1962 | Schramm | 75/124 |
| 3,144,330 | 8/1964 | Storchheim | 75/226 |
| 3,676,109 | 7/1972 | Cooper | 75/124 |
| 4,238,248 | 12/1980 | Gyongyos et al. . | |
| 4,334,923 | 6/1982 | Sherman | 75/124 |
| 4,391,634 | 7/1983 | Kelly et al. | 75/124 |
| 4,684,505 | 8/1987 | Brinegar et al. | 420/81 |
| 4,842,819 | 6/1989 | Huang et al. | 420/418 |
| 4,917,858 | 4/1990 | Eylon et al. | 419/28 |
| 4,961,903 | 10/1990 | McKamey et al. | 420/79 |
| 5,024,109 | 6/1991 | Romero et al. | 73/846.16 |
| 5,032,190 | 7/1991 | Suarez et al. | 148/11.5 R |
| 5,041,166 | 8/1991 | Matsuoka et al. . | |
| 5,158,744 | 10/1992 | Nazmy | 420/62 |
| 5,232,661 | 8/1993 | Matsuo et al. | 420/421 |
| 5,238,645 | 8/1993 | Sikka et al. | 420/79 |
| 5,249,586 | 10/1993 | Morgan et al. | 131/194 |
| 5,269,830 | 12/1993 | Rabin et al. | 75/246 |
| 5,320,802 | 6/1994 | Liu et al. | 420/81 |
| 5,348,702 | 9/1994 | Matsuo et al. | 420/421 |
| 5,350,466 | 9/1994 | Larsen, Jr. et al. | 148/421 |
| 5,370,839 | 12/1994 | Masahashi et al. | 420/418 |
| 5,413,640 | 5/1995 | Manabe et al. . | |
| 5,429,796 | 7/1995 | Larsen, Jr. | 420/590 |
| 5,455,001 | 10/1995 | Hu | 419/38 |
| 5,484,568 | 1/1996 | Sekhar et al. | 419/41 |
| 5,489,411 | 2/1996 | Jha et al. | 419/3 |
| 5,503,794 | 4/1996 | Ritter et al. | 419/28 |
| 5,634,992 | 6/1997 | Kelly et al. | 148/669 |
| 5,746,846 | 5/1998 | Kim et al. | 148/671 |

FOREIGN PATENT DOCUMENTS

| | | |
|---|---|---|
| 648140 | 9/1962 | Canada . |
| 648141 | 9/1962 | Canada . |
| 0 365 175 | 4/1990 | European Pat. Off. . |
| 53-119721 | 10/1978 | Japan . |
| 63-171862 | 7/1988 | Japan . |
| 64-42539 | 2/1989 | Japan . |
| 1-259139 | 10/1989 | Japan . |

OTHER PUBLICATIONS

J. Baker, "Flow and Fracture of FeAl", pp. 101–115, presented at the 1994 TMS Conference.

D.J. Alexander, "Impact Behavior of FeAl Alloy FA–350", pp. 193–202, presented at the 1994 TMS Conference.

C.H. Kong et al., "The Effect of Ternary Additions on the Vacancy Hardening and Defect Structure of FeAl", pp. 231–239, presented at the 1994 TMS Conference.

D.J. Gaydosh et al., "Microstructure and Tensile Properties of Fe–40 At.Pct. Al Alloys with C, Zr, Hf and B Additions" in the Sep. 1989 Met. Trans A, vol. 20A, pp. 1701–1714.

C. G. McKamey et al., "A review of recent developments in $Fe_3Al$–based Alloys", J. of Mater. Res., vol. 6, No. 8, Aug. 1991, pp. 1779–1805.

V.R. Ryabov et al., "Properties of the Intermetallic Compounds of the System Iron–Aluminum", Fiz. Metal. Metalloved. 27, No. 4, (1969), pp. 668–673.

S.M. Barinov et al., "Deformation and Failure in Titanium Aluminide", Izvestiya Aademii Nauk SSSR. Metally, No. 3, 1984, pp. 164–168.

W. Wunderlich, et al., "Enhanced Plasticity by Deformation Twinning of Ti–Al–Base Alloys with Cr and Si", Z. Metallkunde, Nov. 1990, pp. 802–808.

T. Tsujimoto, "Research, Development and Prospects of TiAl Intermetallic Compound Alloys", Titanium and Zirconium, vol. 33, No. 3, 159 (Jul. 1985), pp. 1–19.

M.G. Kenkyusho, "High Temperature Plasticity of Intermetallic Compound TiAl", Material of 53rd Meeting of Superplasticity, Jan. 30, 1990, pp. 1–13.

N. Maeda et al., "Improvement in Ductility of Intermetallic Compound through Grain Super–refinement", Abstract of Autumn Symposium of the Japan Institute of Metals (1989), pp. 1–14.

(List continued on next page.)

*Primary Examiner*—Ngoclan Mai

*Attorney, Agent, or Firm*—Burns, Doane, Swecker & Mathis, L.L.P.

[57] ABSTRACT

A metallic alloy composition is manufactured into products such as press formed or stamped products or rolled products such as sheet, strip, rod, wire or band by one or more cold working steps with intermediate or final flash annealing. The method can include cold rolling an iron, nickel or titanium aluminide alloy and annealing the cold worked product in a furnace by infrared heating. The flash annealing is preferably carried out by rapidly heating the cold worked product to an elevated temperature for less than one minute. The flash annealing is effective to reduce surface hardness of the cold worked product sufficiently to allow further cold working. The product to be cold worked can be prepared by casting the alloy or by a powder metallurgical technique such as tape casting a mixture of metal powder and a binder, roll compacting a mixture of the powder and a binder or plasma spraying the powder onto a substrate. In the case of tape casting or roll compaction, the initial powder product can be heated to a temperature sufficient to remove volatile components. The method can be used to form a cold rolled sheet which is formed into an electrical resistance heating element capable of heating to 900° C. in less than 1 second when a voltage up to 10 volts and up to 6 amps is passed through the heating element.

24 Claims, 3 Drawing Sheets

OTHER PUBLICATIONS

S. Noda et al., "Mechanical Properties of TiAl Intermetallic Compound", Abstract of General Lecture in Autumn Symposium of the Japan Institute of Metals (Nov., 1988), pp. 1–2.

H.A. Lipsitt, "Titanium Aluminides—An Overview", Mat. Res. Soc. Proc., vol. 39, 1985, pp. 351–364.

P.L. Martin et al., "The Effects of Alloying on the Microstructure and Properties of $Ti_3Al$ and TiAl", ASM in Titanium 80, vol. 2, 1980, pp. 1245–1254.

S.H. Whang et al., "Effect of Rapid Solidification in $Ll_0$ TiAl Compound Alloys", ASM Symposium Proceedings on Enhanced Properties in Structural Metals via Rapid Solidification, Materials Week, Oct. 6–9, 1986, pp. 1–7.

J.R. Knibloe et al., "Microstructure And Mechanical Properties of P/M $Fe_3Al$ Alloys", Advances in Powder Metallurgy, vol. 2,, (1990) pp. 219–231.

V.K. Sikka, "Powder Processing of $Fe_3Al$–Based Iron–Aluminide Alloys", Mat. Res. Soc. Symp. Proc., vol. 213, (1991) pp. 901–906.

V.K. Sikka et al., "Powder Production, Processing, and Properties of $Fe_3Al$", pp. 1–11, presented at the 1990 Powder Metallurgy Conference Exhibition in Pittsburgh, PA.

A. LeFort et al., "Mechanical Behaviour of $FeAl_{40}$ Intermetallic Alloys" presented at the Proceedings of International Symposium on Intermetallic Compounds—Structure and Mechanical Properties (JIMIS–6), pp. 579–583, held in Sendai, Japan on Jun. 17–20, 1991.

D. Pocci et al., "Production and Properties of CSM FeAl Intermetallic Alloys" presented at the Minerals, Metals and Materials Society Conference (1994 TMS Conference) on "Processing, Properties and Applications of Iron Aluminides", pp. 19–30, held in San Francisco, California on Feb. 27–Mar. 3, 1994.

J. H. Schneibel, "Selected Properties of Iron Aluminides", pp. 329–341, presented at the 1994 TMS Conference.-

METHOD OF MANUFACTURING METALLIC PRODUCTS SUCH AS SHEET BY COLD WORKING AND FLASH ANNEALING

STATEMENT OF GOVERNMENT RIGHTS

The United States government has rights in this invention pursuant to contract No. DE-AC05-840R21400 between the United States Department of Energy and Lockheed Martin Energy Research Corporation, Inc.

FIELD OF THE INVENTION

The invention relates generally to manufacture of metallic products such as sheet, strip, rod, wire or band, especially of difficult-to-work intermetallic alloys like aluminides of iron, nickel and titanium.

BACKGROUND OF THE INVENTION $Fe_3Al$ intermetallic iron aluminides having a body centered cubic ordered crystal structure are disclosed in U.S. Pat. Nos. 5,320,802; 5,158,744; 5,024,109; and 4,961,903. An iron aluminide alloy having a disordered body centered crystal structure is disclosed in U.S. Pat. No. 5,238,645 wherein the alloy includes, in weight %, 8–9.5 Al, ≦7 Cr, ≦4 Mo, ≦0.05 C, ≦0.5 Zr and ≦0.1 Y, preferably 4.5–5.5 Cr, 1.8–2.2 Mo, 0.02–0.032 C and 0.15–0.25 Zr.

Iron-base alloys containing 3–18 wt % Al, 0.05–0.5 wt % Zr, 0.01–0.1 wt % B and optional Cr, Ti and Mo are disclosed in U.S. Pat. No. 3,026,197 and Canadian Patent No. 648,140. U.S. Pat. No. 3,676,109 discloses an iron-base alloy containing 3–10 wt % Al, 4–8 wt % Cr, about 0.5 wt % Cu, less than 0.05 wt % C, 0.5–2 wt % Ti and optional Mn and B.

Iron-base aluminum containing alloys for use as electrical resistance heating elements are disclosed in U.S. Pat. Nos. 1,550,508; 1,990,650; and 2,768,915 and in Canadian Patent No. 648,141. The alloys disclosed in the '508 patent include 20 wt % Al, 10 wt % Mn; 12–15 wt % Al, 6–8 wt % Mn; or 12–16 wt % Al, 2–10 wt % Cr. All of the specific examples disclosed in the '508 patent include at least 6 wt % Cr and at least 10 wt % Al. The alloys disclosed in the '650 patent include 16–20 wt % Al, 5–10 wt % Cr, ≦0.05 wt % C, ≦0.25 wt % Si, 0.1–0.5 wt % Ti, ≦1.5 wt % Mo and 0.4 . 1.5 wt % Mn and the only specific example includes 17.5 wt % Al, 8.5 wt % Cr, 0.44 wt % Mn, 0.36 wt % Ti, 0.02 wt % C and 0.13 wt % Si. The alloys disclosed in the '915 patent include 10–18 wt % Al, 1–5 wt % Mo, Ti, Ta, V, Cb, Cr, Ni, B and W and the only specific example includes 16 wt % Al and 3 wt % Mo. The alloys disclosed in the Canadian patent include 6–11 ; wt % Al, 3–10 wt % Cr, ≦4 wt % Mn, ≦1 wt % Si, ≦0.4 wt % Ti, ≦0.5 wt % C, 0.2–0.5 wt % Zr and 0.05–0.1 wt % B and the only specific examples include at least 5 wt % Cr.

Resistance heaters of various materials are disclosed in U.S. Pat. No. 5,249,586 and in U.S. patent application Ser. Nos. 07/943,504, 08/118,665, 08/105,346 and 08/224,848.

U.S. Pat. No. 4,334,923 discloses a cold-rollable oxidation resistant iron-base alloy useful for catalytic converters containing ≦0.05% C, 0.1–2% Si, 2–8% Al, 0.02–1% Y, <0.009% P, <0.006% S and <0.009% O.

U.S. Pat. No. 4,684,505 discloses a heat resistant iron-base alloy containing 10–22% Al, 2–12% Ti, 2–12% Mo, 0.1–1.2% Hf, ≦1.5% Si, ≦0.3% C, ≦0.2% B, ≦1.0% Ta, ≦0.5% W, ≦0.5% V, ≦0.5% Mn, ≦0.3% Co, ≦0.3% Nb, and ≦0.2% La.

Japanese Laid-open Patent Application No. 53-119721 discloses a wear resistant, high magnetic permeability alloy having good workability and containing 1.5–17% Al, 0.2–15% Cr and 0.01–8% total of optional additions of <4% Si, <8% Mo, <8% W, <8% Ti, <8% Ge, <8% Cu, <8% V, <8% Mn, <8% Nb, <8% Ta, <8% Ni, <8% Co, <3% Sn, <3% Sb, <3% Be, <3% Hf, <3% Zr, <0.5% Pb, and <3% rare earth metal.

A 1990 publication in Advances in Powder Metallurgy, Vol. 2, by J. R. Knibloe et al., entitled "Microstructure And Mechanical Properties of P/M $Fe_3Al$ Alloys", pp. 219–231, discloses a powder metallurgical process for preparing $Fe_3Al$ containing 2 and 5% Cr by using an inert gas atomizer. To make sheet, the powders were canned in mild steel, evacuated and hot extruded at 1000° C. to an area reduction ratio of 9:1. After removing from the steel can, the alloy extrusion was hot forged at 1000° C. to 0.340 inch thick, rolled at 800° C. to sheet approximately 0.10 inch thick and finish rolled at 650° C. to 0.030 inch.

A 1991 publication in Mat. Res. Soc. Symp. Proc., Vol. 213, by V. K. Sikka entitled "Powder Processing of $Fe_3Al$-Based Iron-Aluminide Alloys," pp. 901–906, discloses a process of preparing 2 and 5% Cr containing $Fe_3Al$-based iron-aluminide powders fabricated into sheet. To make sheet, the powders were canned in mild steel and hot extruded at 1000° C. to an area reduction ratio of 9:1. The steel can was removed and the bars were forged 50% at 1000° C., rolled 50% at 850° C. and finish rolled 50% at 650° C. to 0.76 mm sheet.

A paper by V. K. Sikka et al., entitled "Powder Production, Processing, and Properties of $Fe_3Al$", pp. 1–11, presented at the 1990 Powder Metallurgy Conference Exhibition in Pittsburgh, Pa., discloses a process of preparing $Fe_3Al$ powder by melting constituent metals under a protective atmosphere, passing the metal through a metering nozzle and disintegrating the melt by impingement of the melt stream with nitrogen atomizing gas. An extruded bar was produced by filling a 76 mm mild steel can with the powder, evacuating the can, heating 1½ hour at 1000° C. and extruding the can through a 25 mm die for a 9:1 reduction. A sheet 0.76 mm thick was produced by removing the can, forging 50% at 1000° C., rolling 50% at 850° C. and finish rolling 50% at 650° C.

Oxide dispersion strengthened iron-base alloy powders are disclosed in U.S. Pat. Nos. 4,391,634 and 5,032,190. The '634 patent discloses Ti-free alloys containing 10–40% Cr, 1–10% Al and ≦10% oxide dispersoid. The '190 patent discloses a method of forming sheet from alloy MA 956 having 75% Fe, 20% Cr, 4.5% Al, 0.5% Ti and 0.5% $Y_2O_3$.

A publication by A. LeFort et al., entitled "Mechanical Behavior of $FeAl_{40}$ Intermetallic Alloys" presented at the Proceedings of International Symposium on Intermetallic Compounds—Structure and Mechanical Properties (JIMIS-6), pp. 579– 583, held in Sendai, Japan on Jun. 17–20, 1991, discloses various properties of FeAl alloys (25 wt % Al) with additions of boron, zirconium, chromium and cerium. The alloys were prepared by vacuum casting and extruding at 1100° C. or formed by compression at 1000° C. and 1100° C.

A publication by D. Pocci et al., entitled "Production and Properties of CSM FeAl Intermetallic Alloys" presented at the Minerals, Metals and Materials Society Conference (1994 TMS Conference) on "Processing, Properties and Applications of Iron Aluminides", pp. 19–30, held in San Francisco, Calif. on Feb. 27–Mar. 3, 1994, discloses various properties of $Fe_{40}Al$ intermetallic compounds processed by different techniques such as casting and extrusion, gas atomization of powder and extrusion and mechanical alloying of powder and extrusion and that mechanical alloying has been employed to reinforce the material with a fine oxide dispersion. The article states that FeAl alloys were prepared having a B2 ordered crystal structure, an Al content ranging from 23 to 25 wt % (about 40 at %) and alloying additions of Zr, Cr, Ce, C, B and $Y_2O_3$.

A publication by J. H. Schneibel entitled "Selected Properties of Iron Aluminides", pp. 329–341, presented at the 1994 TMS Conference discloses properties of iron aluminides. This article reports properties such as melting temperatures, electrical resistivity, thermal conductivity, thermal expansion and mechanical properties of various FeAl compositions.

A publication by J. Baker entitled "Flow and Fracture of FeAl", pp. 101–115, presented at the 1994 TMS Conference discloses an overview of the flow and fracture of the B2 compound FeAl. This article states that prior heat treatments strongly affect the mechanical properties of FeAl and that higher cooling rates after elevated temperature annealing provide higher room temperature yield strength and hardness but lower ductility due to excess vacancies.

A publication by D. J. Alexander entitled "Impact Behavior of FeAl Alloy FA-350", pp. 193–202, presented at the 1994 TMS Conference discloses impact and tensile properties of iron aluminide alloy FA-350. The FA-350 alloy includes, in atomic %, 35.8% Al, 0.2% Mo, 0.05% Zr and 0.13% C.

A publication by C. H. Kong entitled "The Effect of Ternary Additions on the Vacancy Hardening and Defect Structure of FeAl", pp. 231–239, presented at the 1994 TMS Conference discloses the effect of ternary alloying additions on FeAl alloys. This article discusses the effects of various ternary alloying additions such as Cu, Ni, Co, Mn, Cr, V and Ti as well as high temperature annealing and subsequent low temperature vacancy-relieving heat treatment.

A publication by D. J. Gaydosh et al., entitled "Microstructure and Tensile Properties of Fe-40 At.Pct. Al Alloys with C, Zr, Hf and B Additions" in the September 1989 Met. Trans A, Vol. 20A, pp. 1701–1714, discloses hot extrusion of gas-atomized powder wherein the powder either includes C, Zr and Hf as prealloyed additions or B is added to a previously prepared iron-aluminum powder.

A publication by C. G. McKamey et al., entitled "A review of recent developments in $Fe_3Al$-based Alloys" in the August 1991 J. of Mater. Res., Vol. 6, No. 8, pp. 1779–1805, discloses techniques for obtaining iron-aluminide powders by inert gas atomization and preparing ternary alloy powders based on $Fe_3Al$ by mixing alloy powders to produce the desired alloy composition and consolidating by hot extrusion, i.e., preparation of $Fe_3Al$-based powders by nitrogen- or argon-gas atomization and consolidation to full density by extruding at 1000° C. to an area reduction of $\leqq$9:1.

U.S. Pat. Nos. 4,917,858; 5,269,830; and 5,455,001 disclose powder metallurgical techniques for preparation of intermetallic compositions by (1) rolling blended powder into green foil, sintering and pressing the foil to full density, (2) reactive sintering of Fe and Al powders to form iron aluminide or by preparing Ni—B—Al and Ni—B—Ni composite powders by electroless plating, canning the powder in a tube, heat treating the canned powder, cold rolling the tube-canned powder and heat treating the cold rolled powder to obtain an intermetallic compound. U.S. Pat. No. 5,484,568 discloses a powder metallurgical technique for preparing heating elements by micropyretic synthesis wherein a combustion wave converts reactants to a desired product. U.S. Pat. No. 5,489,411 discloses a powder metallurgical technique for preparing titanium aluminide foil by plasma spraying a coilable strip, heat treating the strip to relieve residual stresses, placing the rough sides of two such strips together and squeezing the strips together between pressure bonding rolls, followed by solution annealing, cold rolling and intermediate anneals.

U.S. Pat. No. 3,144,330 discloses a powder metallurgical technique for making electrical resistance iron-aluminum alloys by hot rolling and cold rolling elemental powder, prealloyed powders or mixtures thereof into strip. U.S. Pat. No. 2,889,224 discloses a technique for preparing sheet from carbonyl nickel powder or carbonyl iron powder by cold rolling and annealing the powder.

Titanium alloys are the subject of numerous patents and publications including U.S. Pat. Nos. 4,842,819; 4,917,858; 5,232,661; 5,348,702; 5,350,466; 5,370,839; 5,429,796; 5,503,794; 5,634,992; and 5,746,846, Japanese Patent Publication Nos. 63-171862; 1-259139; and 1-42539; European Patent Publication No. 365174 and articles by V. R. Ryabov et al entitled "Properties of the Intermetallic Compounds of the System Iron-Aluminum" published in Metal Metalloved, 27, No.4, 668–673, 1969; S. M. Barinov et al entitled "Deformation and Failure in Titanium Aluminide" published in Izvestiya Akademii Nauk SSSR Metally, No. 3, 164–168, 1984; W. Wunderlich et al entitled "Enhanced Plasticity by Deformation Twinning of Ti—Al-Base Alloys with Cr and Si" published in Z. Metallkunde, 802–808, November 1990; T. Tsujimoto entitled "Research, Development, and Prospects of TiAl Intermetallic Compound Alloys" published in Titanium and Zirconium, Vol. 33, No. 3, 19 pages, July 1985; N. Maeda entitled "High Temperature Plasticity of Intermetallic Compound TiAl" presented at Material of 53$^{rd}$ Meeting of Superplasticity, 13 pages, Jan. 30, 1990; N. Maeda et al entitled "Improvement in Ductility of Intermetallic Compound through Grain Super-refinement" presented at Autumn Symposium of the Japan Institute of Metals, 14 pages, 1989; S. Noda et al entiitled "Mechanical Properties of TiAl Intermetallic Compound" presented at Autumn Symposium of the Japan Institute of Metals, 3 pages, 1988; H. A. Lipsitt entitled "Titanium Aluminides—An Overview" published in Mat. Res. Soc. Symp. Proc. Vol. 39, 351–364, 1985; P. L. Martin et al entitled "The Effects of Alloying on the Microstructure and Properties of $Ti_3Al$ and TiAl" published by ASM in Titanium 80, Vol. 2, 1245–1254, 1980; S. H. Whang et al entitled "Effect of Rapid Solidification in $L1_0$ TiAl Compound Alloys" ASM Symposium Proceedings on Enhanced Properties in Structural Metals Via Rapid Solidification, Materials Week, 7 pages, 1986; and D. Vujic et al entitled "Effect of Rapid Solidification and Alloying Addition on Lattice Distortion and Atomic Ordering in $L1_0$ TiAl Alloys and Their Ternary Alloys" published in Metallurgical Transactions A, Vol. 19A, 2445–2455, October 1988.

Methods by which TiAl aluminides can be processed to achieve desirable properties are disclosed in numerous patents and publications such as those mentioned above. In addition, U.S. Pat. No. 5,489,411 discloses a powder metallurgical technique for preparing titanium aluminide foil by plasma spraying a coilable strip, heat treating the strip to relieve residual stresses, placing the rough sides of two such strips together and squeezing the strips together between pressure bonding rolls, followed by solution annealing, cold rolling and intermediate anneals. U.S. Pat. No. 4,917,858 discloses a powder metallurgical technique for making titanium aluminide foil using elemental titanium, aluminum and other alloying elements. U.S. Pat. No. 5,634,992 discloses a method of processing a gamma titanium aluminide by consolidating a casting and heat treating the consolidated casting above the eutectoid to form gamma grains plus lamellar colonies of alpha and gamma phase, heat treating below the eutectoid to grow gamma grains within the colony structure and heat treating below the alpha transus to reform any remaining colony structure a structure having $\alpha_2$ laths within gamma grains.

Based on the foregoing, there is a need in the art for an economical technique for preparing metal products which undergo work hardening such as iron, nickel and titanium aluminides. It would be desirable if aluminide compositions could be prepared by an economical technique in order to form an aluminide product.

SUMMARY OF THE INVENTION

The invention provides a method of manufacturing a cold worked product from a metallic alloy composition, comprising steps of (a) preparing a work hardened product by cold working a metallic alloy composition to a degree sufficient to provide a surface hardened zone thereon; (b) preparing a heat treated product by passing the work hardened product through a furnace such that the work hardened product is flash annealed for less than one minute; and optionally (c) repeating steps (a) and (b) until a cold worked product of desired size is obtained. The metallic alloy can comprise an iron base alloy such as steel, copper or copper base alloy, aluminum or aluminum base alloy, titanium or titanium base alloy, zirconium or zirconium base alloy, nickel or nickel base alloy or intermetallic alloy composition. The metallic alloy is preferably an iron aluminide alloy, a nickel aluminide alloy or a titanium aluminide alloy. The flash annealing is preferably carried out by infrared heating and the cold working preferably comprises cold rolling the alloy into sheet, strip, rod, wire or band. Alternatively, the cold working can comprise cold stamping or cold pressing the metallic alloy into a shaped product.

The method can include casting the alloy and hot working the casting prior to step (a). Alternatively, the alloy can be prepared by a powder metallurgical technique such as by tape casting or roll compaction. For instance, the alloy can be prepared by tape casting a powder mixture of the alloy and a binder so as to form a non-densified metal sheet with a porosity of at least 30%, heating the tape casting to drive off volatile components and working the non-densified metal sheet into the work hardened product. In the case of roll compaction, a powder mixture of the alloy and a binder is rolled into a non-densified metal sheet with a porosity of at least 30%, the rolled sheet is heat treated to drive off volatile components and the non-densified metal sheet is cold worked into the work hardened product. Still yet, the method can include plasma spraying a powder of the alloy onto a substrate so as to form a non-densified metal sheet with a porosity of less than 10% and cold working the non-densified metal sheet into the work hardened product.

According to a preferred embodiment, the cold worked product is formed into an electrical resistance heating element capable of heating to 900° C. in less than 1 second when a voltage up to 10 volts and up to 6 amps is passed through the heating element. The resistance heating element can be used for various heating applications such as part of a heating fixture of a cigarette smoking device. The electrical resistance heating element preferably has an electrical resistivity of 80 to 400, preferably 140 to 200 $\mu\Omega$.cm.

The intermetallic alloy can comprise $Fe_3Al$, $Fe_2Al_5$, $FeAl_3$, FeAl, FeAlC, $Fe_3AlC$ or mixtures thereof. The intermetallic alloy can comprise an iron aluminide having, in weight %, ≦32% Al, ≦2% Mo, ≦1% Zr, ≦2% Si, ≦30% Ni, ≦10% Cr, ≦0.3% C, ≦0.5% Y, ≦0.1% B, ≦1% Nb, ≦3% W and ≦1% Ta. For instance, the alloy can include, in weight %, 20–32% Al, 0.3–0.5% Mo, 0.05–0.3% Zr, 0.01–0.5% C, ≦0.1% B, ≦1% oxide particles, balance Fe. A preferred iron aluminide alloy includes, in weight %, 20–32% Al, 0.3–0.5% Mo, 0.05–0.3% Zr, 0.01–0.5% C, ≦1% $Al_2O_3$ particles, ≦1% $Y_2O_3$ particles, balance Fe.

DETAILED DESCRIPTION OF THE PREFERRED EMBODIMENTS

The invention provides a new and economic process for manufacturing cold worked products of metallic materials which undergo work hardening during cold working thereof. The process of the invention is especially useful in the manufacture of rolled, stamped or press formed metallic alloys of iron base alloys such as steel, copper or copper base alloys, aluminum or aluminum base alloys, titanium or titanium base alloys, zirconium or zirconium base alloys, nickel or nickel base alloys, or intermetallic alloy compositions such as aluminide materials. The metallic materials can be prepared by any technique which directly or indirectly provides the materials in a form ready for working to a desired shape. For example, the materials can be prepared by casting, powder metallurgical or plasma spraying techniques. In the case of casting, a suitable alloy can be melted, cast into a shape, and worked into a final or intermediate shape. In the case of powder metallurgy, elemental powders can be subjected to reaction synthesis to form a desired alloy composition or a suitable alloy composition can be atomized to form a prealloyed powder, after which the powder in either case can be sintered and worked into a final or intermediate shape. In the case of plasma spraying, a suitable alloy composition can be melted and sprayed onto a substrate to form an intermediate shape. According to the invention, the intermediate shape can be formed into a final sized shape in a manner which allows the number of working steps such as rolling passes to be reduced.

In general, difficult-to-work metal compositions such as aluminides, especially in the form of thin strips, have a tendency to work harden during the forming process. It was found during development of the process of the invention that work hardening is first induced in a thin surface layer and gradually builds up throughout the thickness of the material undergoing cold working such as reduction in thickness. According to the invention the initial thin work hardened layer is subjected to a heat treatment which lowers the hardness of the surface layer. A particularly advantageous heat treatment according to the invention is a flash annealing treatment wherein the surface of the strip is heated rapidly to a temperature sufficient to relieve built-up stresses in the surface layer. The flash annealing treatment can be carried out by any suitable technique such as by using infrared, laser, induction, etc., heating equipment. An especially preferred heating technique in the case of making sheet material is a furnace equipped with infrared heating lamps which are arranged to heat the surface of a strip passing through the furnace. The effectiveness of flash annealing in reducing surface hardness is explained below with reference to an exemplary process of making iron aluminide strip.

Figure 1:
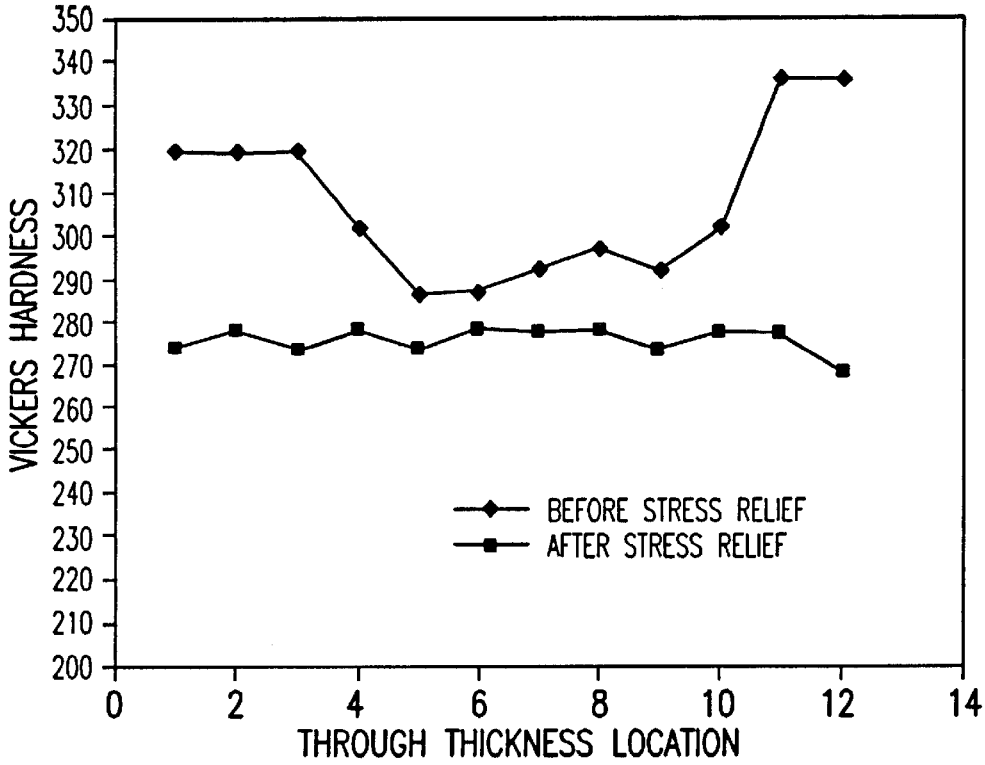
FIG. 1 shows the hardness profiles of a roller leveled FeAl strip.

FIG. 1 shows the hardness profiles of a roller leveled FeAl strip before and after stress relief annealing of the strip. As shown by the ♦ marks representing before stress relief anneal, the strip has a surface hardened zone in that the Vickers hardness is significantly higher at its surfaces than in the center thereof. However, as shown by the ■ marks, the hardness is made substantially uniform throughout the strip thickness after stress relief annealing by flash annealing in accordance with the invention.

Figure 2C:
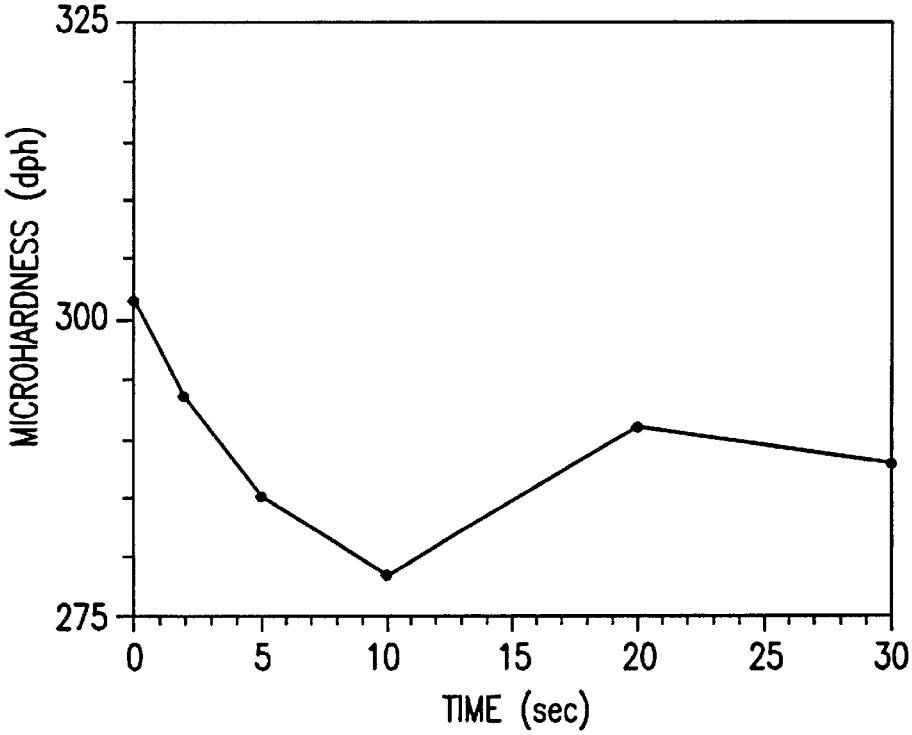
FIG. 2*c* shows the effect of heating time on hardness for FeAl 8-mil sheet heated at 500° C.
Figure 2A:
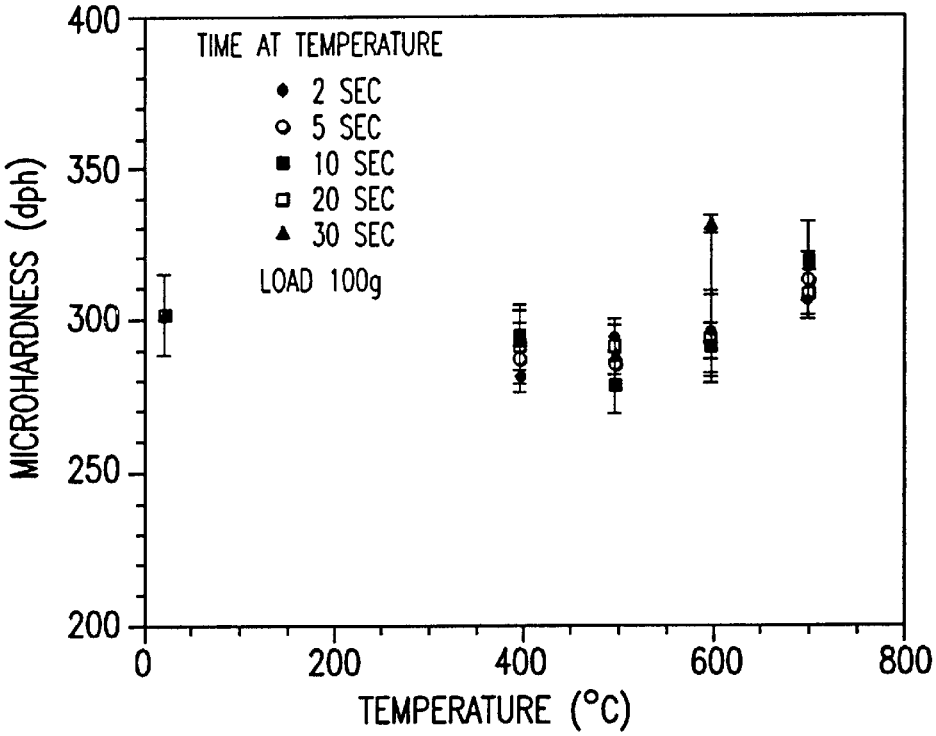
FIG. 2*a* shows the effect of heating on hardness of 8-mil FeAl sheet.

FIG. 2*a* shows the effect of heating times and temperatures on microhardness of 8-mil punched FeAl sheet. As shown by the ● marks representing heating for 2 seconds, the hardness is reduced to the lowest level at around 400° C. Likewise, as shown by the ○ marks representing heating for 5 seconds, the hardness is reduced to the lowest level at around 400 to 500° C. The ■ marks representing heating for 10 seconds indicate that the hardness is reduced to the lowest level at around 500° C. As shown by the □ marks representing heating for 20 seconds, the hardness is reduced to the lowest level at around 500° C. The ▲ marks representing heating for 30 seconds show that the hardness is reduced to the lowest level at around 500° C. Accordingly, flash annealing at around 400 to 500° C. for 2 to 30 seconds is sufficient to reduce the hardness of the surface layer of a cold rolled FeAl strip.

Figure 2B:
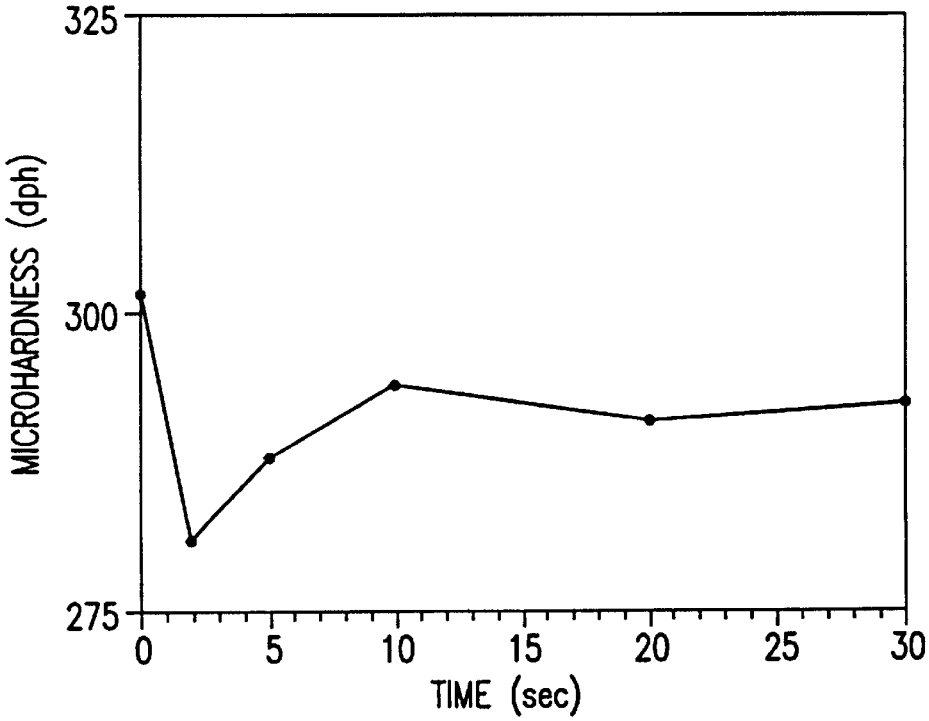
FIG. 2*b* shows the effect of heating time on hardness for FeAl 8-mil sheet heated at 400° C.

FIG. 2*b* shows the effect of heating time on microhardness for FeAl 8-mil sheet heated at 400° C. As shown by the graph, after about 10 seconds of heating the hardness is reduced to a level which remains substantially constant for longer heating times.

FIG. 2*c* shows the effect of heating time on microhardness for FeAl 8-mil sheet heated at 500° C. As shown by the graph, after about 10 seconds of heating the hardness is reduced by the greatest amount and longer heating times do not further reduce the hardness of the strip.

Figure 3:
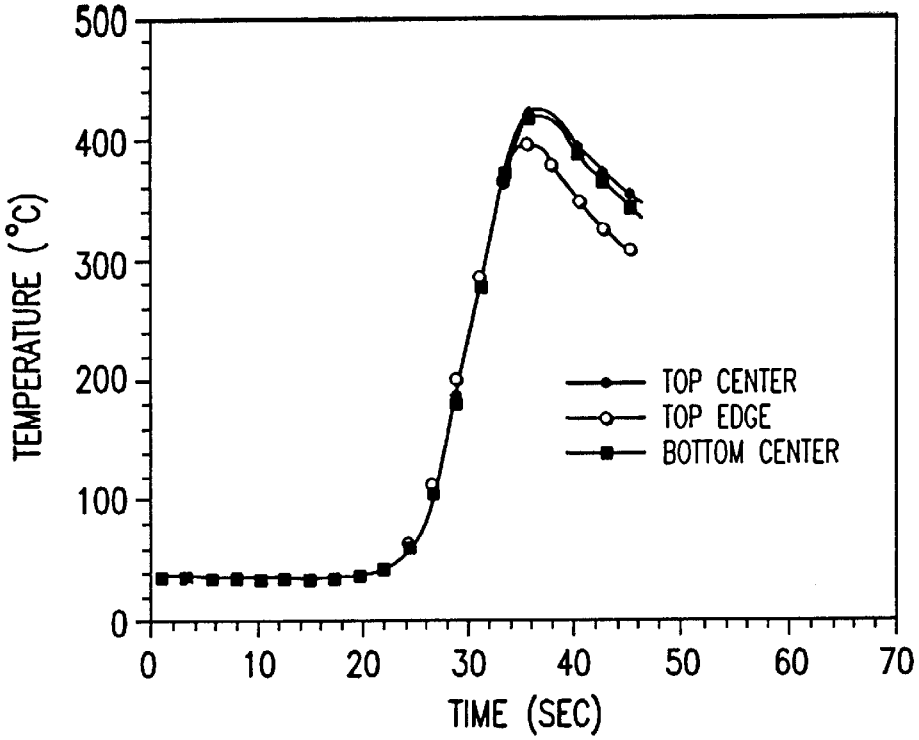
FIG. 3 shows the effect of heating time on temperatures at different locations on FeAl 8-mil sheet passed through an infrared heating furnace.

FIG. 3 shows the effect of heating time on temperatures at different locations on FeAl 8-mil sheet passed through an infrared heating furnace. In this graph, the ● marks represent the top center of the strip, the ○ marks represent the top edge of the strip and the ■ marks represent the bottom center of the strip. The infrared furnace included a infrared lamps operated at 37% power and the strip was passed through the furnace at 2 ft/min. The temperature of the strip reached around 400° C. after about 35 seconds. As the strip passed through the furnace, the three locations on the strip were initially heated to essentially the same temperature for the first 35 seconds. Then, as the temperature of the strip dropped, the top and bottom centers of the strip remained close in temperature and the top edge was about 50° C. cooler than the centers of the strip.

Figure 4:
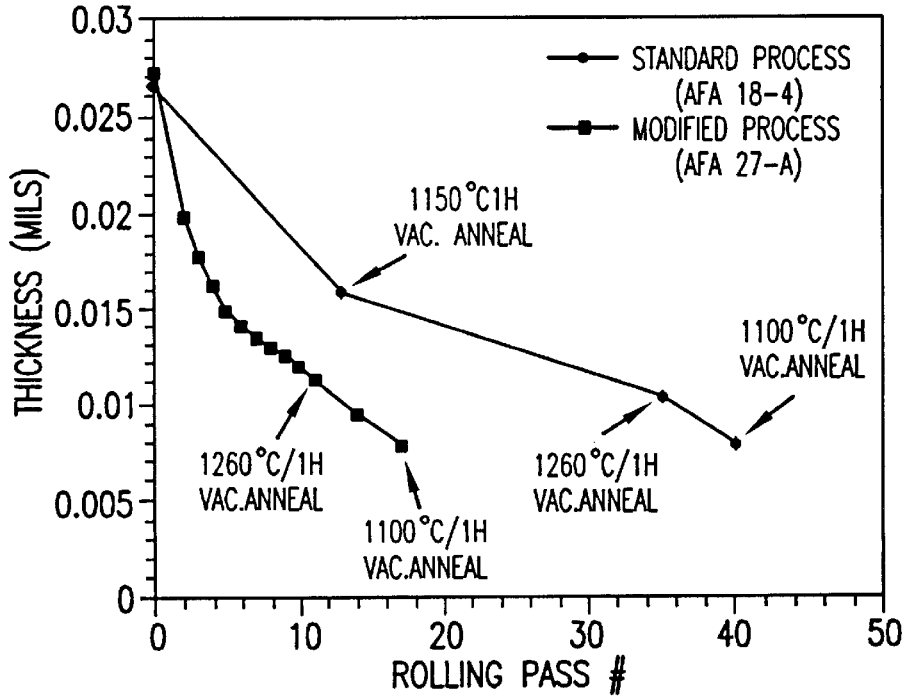
FIG. 4 shows a comparison of rolling processes for tape cast FeAl sheets.

FIG. 4 shows a comparison of rolling processes for 26-mil tape cast FeAl sheets wherein the ● marks represent a comparative process involving 40 cold rolling passes and the ■ marks represent the process according to the invention. The comparative process required two intermediate vacuum anneals (one hour at 1150° C. and one hour at 1260° C.) and a final anneal (one hour at 1100° C.) whereas the process according to the invention required only one intermediate vacuum anneal (one hour at 1260° C.) and a final vacuum anneal (one hour 1100° C.). However, whereas the comparative process required 40 cold rolling passes to obtain 8-mil strip, the process according to the invention, wherein flash annealing is carried out subsequent to each rolling step, required only 17–18 rolling passes to obtain 8-mil strip. Thus, because the process according to the invention can reduce the number of cold rolling steps required to produce strip of a desired thickness, the process can significantly increase production efficiency.

In cold rolling iron aluminide to thin strip it is advantageous to conduct the intermediate annealing steps in a vacuum to minimize oxidation of the strip. Use of such protective atmospheres necessarily entails use of expensive furnace equipment and slows down the manufacturing process. In accordance with the invention, it is possible to increase the rate of production of sheet material by reducing the number of manufacturing steps and lower costs by avoiding the need for protective atmospheres during the flash annealing step.

The method according to the invention can be used to prepare various iron aluminide alloys containing at least 4% by weight (wt %) of aluminum and having various structures depending on the Al content, e.g., a $Fe_3Al$ phase with a $DO_3$ structure or an FeAl phase with a B2 structure. The alloys preferably are ferritic with an austenite-free microstructure and may contain one or more alloy elements selected from molybdenum, titanium, carbon, rare earth metal such as yttrium or cerium, boron, chromium, oxide such as $Al_2O_3$ or $Y_2O_3$, and a carbide former (such as zirconium, niobium and/or tantalum) which is useable in conjunction with the carbon for forming carbide phases within the solid solution matrix for the purpose of controlling grain size and/or precipitation strengthening.

The aluminum concentration in the FeAl phase alloys can range from 14 to 32% by weight (nominal) and the Fe—Al alloys when wrought or powder metallurgically processed can be tailored to provide selected room temperature ductilities at a desirable level by annealing the alloys in a suitable atmosphere at a selected temperature greater than about 700° C. (e.g., 700–1100° C.) and then furnace cooling, air cooling or oil quenching the alloys while retaining yield and ultimate tensile strengths, resistance to oxidation and aqueous corrosion properties.

The concentration of the alloying constituents used in forming the Fe—Al alloys is expressed herein in nominal weight percent. However, the nominal weight of the aluminum in these alloys essentially corresponds to at least about 97% of the actual weight of the aluminum in the alloys. For example, a nominal 18.46 wt % may provide an actual 18.27 wt % of aluminum, which is about 99% of the nominal concentration.

The Fe—Al alloys can be processed or alloyed with one or more selected alloying elements for improving properties such as strength, room-temperature ductility, oxidation resistance, aqueous corrosion resistance, pitting resistance, thermal fatigue resistance, electrical resistivity, high temperature sag or creep resistance and resistance to weight gain.

The aluminum containing iron based alloys can be manufactured into electrical resistance heating elements. However, the alloy compositions disclosed herein can be used for other purposes such as in thermal spray applications wherein the alloys could be used as coatings having oxidation and corrosion resistance. Also, the alloys could be used as oxidation and corrosion resistant electrodes, furnace components, chemical reactors, sulfidization resistant materials, corrosion resistant materials for use in the chemical industry, pipe for conveying coal slurry or coal tar, substrate materials for catalytic converters, exhaust pipes for automotive engines, porous filters, etc.

According to one aspect of the invention, the geometry of the alloy can be varied to optimize heater resistance according to the formula: $R=\rho(L/W\times T)$ wherein R=resistance of the heater, ρ=resistivity of the heater material, L=length of heater, W=width of heater and T=thickness of heater. The resistivity of the heater material can be varied by adjusting the aluminum content of the alloy, processing of the alloy or incorporating alloying additions in the alloy.

The heater material can be made in various ways. For instance, the heater material can be made by a casting or powder metallurgical route. In the powder metallurgical route, the alloy can be made from a prealloyed powder, by mechanically alloying the alloy constituents or by reacting powders of iron and aluminum after a powder mixture thereof has been shaped into an article such as a sheet of cold rolled powder. The mechanically alloyed powder can be processed by conventional powder metallurgical techniques such as by canning and extruding, slip casting, centrifugal casting, hot pressing and hot isostatic pressing. Another technique is to use pure elemental powders of Fe, Al and optional alloying elements. If desired, electrically insulating and/or electrically conductive particles can be incorporated in the powder mixture to tailor physical properties and high temperature creep resistance of the heater material.

The heater material can be produced from a mixture of powder having different fractions but a preferred powder mixture comprises particles having a size smaller than 100 mesh. The powder can be produced by gas atomization in which case the powder may have a spherical morphology. Alternatively, the powder can be made by water or polymer atomization in which case the powder may have an irregular morphology. Polymer atomized powder has higher carbon content and lower surface oxide than water atomized powder. The powder produced by water atomization can include an aluminum oxide coating on the powder particles and such aluminum oxide can be broken up and incorporated in the heater material during thermomechanical processing of the powder to form shapes such as sheet, bar, etc. The alumina particles, depending on size, distribution and amount thereof, can be effective in increasing resistivity of the iron aluminum alloy. Moreover, the alumina particles can be used to increase strength and creep resistance with or without reduction in ductility.

In order to improve properties of the alloy such as thermal conductivity and/or resistivity, metallic elements and/or particles of electrically conductive and/or electrically insulating metal compounds can be incorporated in the alloy. Such elements and/or metal compounds include oxides, nitrides, silicides, borides and carbides of elements selected from groups IVb, Vb and VIb of the periodic table. The carbides can include carbides of Zr, Ta, Ti, Si, B, etc., the borides can include borides of Zr, Ta, Ti, Mo, etc., the silicides can include silicides of Mg, Ca, Ti, V, Cr, Mn, Zr, Nb, Mo, Ta, W, etc., the nitrides can include nitrides of Al, Si, Ti, Zr, etc., and the oxides can include oxides of Y, Al, Si, Ti, Zr, etc. In the case where the FeAl alloy is oxide dispersion strengthened, the oxides can be added to the powder mixture or formed in situ by adding pure metal such as Y to a molten metal bath whereby the Y can be oxidized in the molten bath, during atomization of the molten metal into powder and/or by subsequent treatment of the powder. For instance, a heater material can include particles of electrically conductive material such as nitrides of transition metals (Zr, Ti, Hf), carbides of transition metals, borides of transition of metals and $MoSi_2$ for purposes of providing good high temperature creep resistance up to 1200° C. and also excellent oxidation resistance. A heater material may also incorporate particles of electrically insulating material such as $Al_2O_3$, $Y_2O_3$, $Si_3N_4$, $ZrO_2$ for purposes of making the heater material creep resistant at high temperature and also enhancing thermal conductivity and/or reducing the thermal coefficient of expansion of the heater material.

In preparing an iron aluminide alloy by casting, the casting can be cut, if needed, into an appropriate size and then reduced in thickness by forging or hot working at a temperature in the range of about 900 to 1100° C., hot rolling at a temperature in the range of about 750 to 1100° C., warm rolling at a temperature in the range of about 600 to 700° C., and/or cold rolling at room temperature. Each pass through the cold rolls can provide a 20 to 30% reduction in thickness and is followed by flash annealing at 400 to 500° C. The cold rolled product can also be heat treated in air, inert gas or vacuum at a temperature in the range of about 700 to about 1050° C., e.g., about 800° C. for one hour. For instance, the alloy can be cut into 0.5 inch thick pieces, forged at 1000° C. to reduce the thickness of the alloy specimens to 0.25 inch (50% reduction), then hot rolled at 800° C. to further reduce the thickness of the alloy specimens to 0.1 inch (60% reduction), and then warm rolled at 650° C. to provide a final thickness of 0.030 inch (70% reduction) sheet. The 0.030 inch sheet can then be cold rolled and flash annealed in accordance with the invention.

According to the invention, an intermetallic alloy composition can be formed into sheet by consolidating prealloyed powder, cold working and heat treating the cold rolled sheet. For example, a prealloyed powder can be consolidated into a sheet which can be cold worked (i.e., worked without applying external heat during working) to a desired final thickness.

According to this embodiment, a sheet having an intermetallic alloy composition is prepared by a powder metallurgical technique wherein a non-densified metal sheet is formed by consolidating a prealloyed powder having an intermetallic alloy composition, a cold rolled sheet is formed by cold rolling the non-densified metal sheet so as to densify and reduce the thickness thereof, and the cold rolled sheet is heat treated to sinter, anneal, stress relieve and/or degas the cold rolled sheet. The consolidating step can be carried out in various ways such as by roll compaction, tape casting or plasma spraying. In the consolidating step, a sheet or narrow sheet in the form of a strip can be formed having any suitable thickness such as less than 0.1 inch. This strip is then cold rolled in one or more passes to a final desired thickness with at least one heat treating step such as a sintering, annealing or stress relief heat treatment. According to the invention, at least one of the annealing steps comprises a flash annealing heat treatment. This process provides a simple and economic manufacturing technique for preparing intermetallic alloy materials such as iron aluminides which are known to have poor ductility and high work hardening potential at room temperature.

In the roll compaction process, a prealloyed powder is processed as follows. Pure elements and trace alloys are preferably water atomized or polymer atomized to form a prealloyed irregular shaped powder of an intermetallic composition such as an aluminide (e.g. iron aluminide, nickel aluminide, or titanium aluminide) or other intermetallic composition. Water or polymer atomized powder is preferred over gas atomized powder for subsequent roll compaction since the irregularly shaped surfaces of the water atomized powder provide better mechanical interlocking than the spherical powder obtained from gas atomization. Polymer atomized powder is preferred over water atomized powder since the polymer atomized powder provides less surface oxide on the powder.

The prealloyed powder is sieved to a desired particle size range, blended with an organic binder, mixed with an optional solvent and blended together to form a blended powder. In the case of iron aluminide powder, the sieving step preferably provides a powder having a particle size within the range of −100 to +325 mesh which corresponds to a particle size of 43 to 150 $\mu$m. In order to improve the flow properties of the powder, less than 5%, preferably 3–5% of the powder has a particle size of less than 43 $\mu$m.

Green strips are prepared by roll compaction wherein the blended powder is fed from a hopper through a slot into a space between two compaction rolls. In a preferred embodiment, the roll compaction produces a green strip of iron aluminide having a thickness of about 0.026 inch and the green strip can be cut into strips having dimensions such as 36 inches by 4 inches. The green strips are subjected to a heat treatment step to remove volatile components such as the binder and any organic solvents. The binder burn out can be carried out in a furnace at atmospheric or reduced pressure in a continuous or batch manner. For instance, a batch of iron aluminide strips can be furnace set at a suitable temperature such as 700–900° F. (371–482°) for a suitable amount of time such as 6–8 hours at a higher temperature such as 950° F. (510° C.). During this step, the furnace can be at 1 atmosphere pressure with nitrogen gas flowing therethrough so as to remove most of the binder, e.g., at least 99% binder removal. This binder removal step results in very fragile green strips which are then subjected to primary sintering in a vacuum furnace.

In the primary sintering step, the porous brittle de-bindened strips are preferably heated under conditions suitable for effecting partial sintering with or without densification of the powder. This sintering step can be carried out in a furnace at reduced pressure in a continuous or batch manner. For instance, a batch of the de-bindened iron aluminide strips can be heated in a vacuum furnace at a suitable temperature such as 2300° F. (1260° C.) for a suitable time such as one hour. The vacuum furnace can be maintained at any suitable vacuum pressure such as $10^{-4}$ to $10^{-5}$ Torr. In order to prevent loss of aluminum from the strips during sintering, it is preferable to maintain the sintering temperature low enough to avoid vaporizing aluminum yet provide enough metallurgical bonding to allow subsequent rolling. Further, vacuum sintering is preferred to avoid oxidation of the non-densified strips. However, protective atmospheres such as hydrogen, argon and/or nitrogen with proper dew points such as −50° F. or less thereof could be used in place of the vacuum.

In the next step, the presintered strips are preferably subjected to cold rolling in air to a final or intermediate thickness. In this step, the porosity of the green strip can be substantially reduced, e.g., from around 50% to less than 10% porosity. Due to the hardness of the intermetallic alloy, it is advantageous to use a 4-high rolling mill wherein the rollers in contact with the intermetallic alloy strip preferably have carbide rolling surfaces. However, any suitable roller construction can be used such as stainless steel rolls. Further, by using the flash annealing in accordance with the invention it is not necessary to use carbide rollers for the cold rolling. If steel rollers are used, the amount of reduction is preferably limited such that the rolled material does not deform the rollers as a result of work hardening of the intermetallic alloy. The cold rolling step is preferably carried out to reduce the strip thickness by at least 30%, preferably at least about 50%. For instance, the 0.026 inch thick presintered iron aluminide strips can be cold rolled to 0.013 inch thickness in a single cold rolling step with single or multiple passes.

After each cold rolling step, the cold rolled strips are subjected to heat treating to anneal the strips. The annealing can comprise primary annealing in a vacuum furnace in a batch manner or in a furnace with gases like $H_2$, $N_2$ and/or Ar in a continuous manner and at a suitable temperature to relieve stress and/or effect further densification of the powder. In the case of iron aluminide, the primary annealing can be carried at any suitable temperature such as 1652–2372° F. (900 to 1300° C.), preferably 1742–2102° F. (950 to 1150° C.) for one or more hours in a vacuum furnace. For example, the cold rolled iron aluminide strip can be annealed for one hour at 2012° F. (1100° C.) but surface quality of the sheet can be improved in the same or different heating step by annealing at higher temperatures such as 2300° F. (1260° C.) for one hour. The primary annealing can accompany or be replaced by a flash annealing step as described earlier.

After the annealing step, the strips can be optionally trimmed to desirable sizes. For instance, the strip can be cut in half and subjected to further cold rolling and heat treating steps.

In the next step, the primary rolled strips are cold rolled to reduce the thickness thereof. For instance, the iron aluminide strips can be rolled in a 4-high rolling mill so as to reduce the thickness thereof from 0.013 inch to 0.010 inch. This step achieves a reduction of at least 15%, preferably about 25%. Each rolling step is preferably followed by a flash annealing step as previously described. However, if desired, one or more annealing steps can be eliminated, e.g., a 0.024 inch strip can be primary cold rolled directly to 0.010 inch. Subsequently, the secondary cold rolled strips are optionally subjected to secondary sintering and annealing. In the secondary sintering and annealing step, the strips can be heated in a vacuum furnace in a batch manner or in a furnace with gases like $H_2$, $N_2$ and/or Ar in a continuous manner to achieve full density. For example, a batch of the iron aluminide strips can be heated in a vacuum furnace to a temperature of 2300° F. (1260° C.) for one hour.

After the secondary sintering and annealing step, the strips can optionally be subjected to secondary trimming to shear off ends and edges as needed such as in the case of edge cracking. Then, the strips can be subjected to a third and final cold rolling step with intermediate flash annealing. The cold rolling can reduce the thickness of the strips by 15% or more. Preferably, the strips are cold rolled to a final desired thickness such as from 0.010 inch to 0.008 inch. After the third or final cold rolling step, the strips can be subjected to a final annealing step in a continuous or batch manner at a temperature above the recrystallization temperature. For instance, in the final annealing step, a batch of the iron aluminide strips can be heated in a vacuum furnace to a suitable temperature such as 2012° F. (1100° C.) for about one hour. During the final annealing the cold rolled sheet is preferably recrystallized to a desired average grain size such as about 10 to 30 $\mu$m, preferably around 20 $\mu$m. Then, the strips can optionally be subjected to a final trimming step wherein the ends and edges are trimmed and the strip is slit into narrow strips having the desired dimensions for further processing into tubular heating elements.

The trimmed strips can be subjected to a stress relieving heat treatment to remove thermal vacancies created during the previous processing steps. The stress relief treatment increases ductility of the strip material (e.g., the room temperature ductility can be raised from around 1% to around 34%). In the stress relief heat treatment, a batch of the strips can be heated in a furnace at atmospheric pressure or in a vacuum furnace. For instance, the iron aluminide strips can be heated to around 1292° F. (700° C.) for two hours and cooled by slow cooling in the furnace (e.g., at ≦2–5° F./min) to a suitable temperature such as around 662° F. (350° C.) followed by quenching. During stress relief annealing it is preferable to maintain the iron aluminide strip material in a temperature range wherein the iron aluminide is in the B2 ordered phase.

The stress relieved strips can be processed into tubular heating elements by any suitable technique. For instance, the strips can be laser cut, mechanically stamped or chemical photoetched to provide a desired pattern of individual heating blades. For instance, the cut pattern can provide a series of hairpin shaped blades extending from a rectangular base portion which when rolled into a tubular shape and joined provides a tubular heating element with a cylindrical base and a series of axially extending and circumferentially spaced apart heating blades. Alternatively, an uncut strip could be formed into a tubular shape and the desired pattern cut into the tubular shape to provide a heating element having the desired configuration.

To avoid variation in properties of the cold rolled sheet, it is desirable to control porosity, distribution of oxide particles, grain size and flatness. The oxide particles result from oxide coatings on the water atomized powder which break up and are distributed in the sheet during cold rolling of the sheet. Nonuniform distribution of oxide content could cause property variations within a specimen or result in specimen-to-specimen variations. Flatness can be adjusted by tension control during rolling. In general, cold rolled material can exhibit room temperature yield strength of 55–70 ksi, ultimate tensile strength of 65–75 ksi, total elongation of 1–6%, reduction of area of 7–12% and electrical resistivity of about 150–160 $\mu\Omega$.cm whereas the elevated temperature strength properties at 750° C. include yield strength of 36–43 ksi, ultimate tensile strength of 42–49 ksi, total elongation of 22–48% and reduction of area of 26–41%.

According to the tape casting technique, a prealloyed powder is formed into a sheet by tape casting. However, whereas water or polymer atomized powder is preferred for the roll compaction process, gas atomized powder is preferred for tape casting due to its spherical shape and low oxide contents. The gas atomized powder is sieved as in the roll compaction process and the sieved powder is blended with organic binder and solvent so as to produce a slip, the slip is tape cast into a thin sheet and the tape cast sheet is cold rolled and heat treated as set forth in the roll compaction embodiment.

According to the plasma spraying technique, a prealloyed powder is formed into a non-densified metallic sheet by plasma spraying powders of an intermetallic alloy onto a substrate. The sprayed droplets are collected and solidified on the substrate in the form of a flat sheet which is cooled by a coolant on the opposite thereof. The spraying can be carried out in vacuum, an inert atmosphere or in air. The sprayed sheets can be provided in various thicknesses and because the thicknesses can be closer to the final desired thickness of the sheet, the thermal spraying technique offers advantages over the roll compaction and tape casting techniques in that the final sheet can be produced with fewer cold rolling and annealing steps.

In a preferred plasma spraying technique according to the invention, a strip having a width such as 4 or 8 inches is prepared by depositing gas, water or polymer atomized prealloyed powder on a substrate by moving a plasma torch back and forth across a substrate as the substrate moves in a given direction. The strip can be provided in any desired thickness such as up to 0.1 inch. In plasma spraying, the powder is atomized such that the particles are molten when they hit the substrate. The result is a highly dense (e.g., over 95% dense) film having a smooth surface. In order to minimize oxidation of the molten particles, a shroud can be used to contain a protective atmosphere such as argon or nitrogen surrounding the plasma jet. However, if the plasma spray process is carried out in air, oxide films can form on the molten droplets and thus lead to incorporation of oxides in the deposited film. The substrate is preferably a stainless steel grit blasted surface which provides enough mechanical bonding to hold the strip while it is deposited but allows the strip to be removed for further processing. According to a preferred embodiment, an iron aluminide strip is sprayed to a thickness of 0.020 inch, a thickness which can be cold rolled in a series of passes to 0.010 inch with intermediate flash annealing, cold rolled to 0.008 inch and subjected to final annealing and stress relief heat treating.

In general, the thermal spraying technique provides a denser sheet than is obtained by tape casting or roll compaction. Of the thermal spray techniques, the plasma spraying technique allows use of water, gas or polymer atomized powder whereas the spherical powder obtained by gas atomization does not compact as well as the water atomized powder in the roll compaction process. Compared to tape casting, the thermal spraying process provides less residual carbon since it is not necessary to use a binder or solvent in the thermal spraying process. On the other hand, the thermal spray process is susceptible to contamination by oxides. Likewise, the roll compaction process is susceptible to oxide contamination when using water atomized powder, i.e., the surface of the water quenched powder may have surface oxides whereas the gas atomized powder can be produced with little or no surface oxides.

The foregoing has described the principles, preferred embodiments and modes of operation of the present invention. However, the invention should not be construed as being limited to the particular embodiments discussed. Thus, the above-described embodiments should be regarded as illustrative rather than restrictive, and it should be appreciated that variations may be made in those embodiments by workers skilled in the art without departing from the scope of the present invention as defined by the following claims.

What is claimed is:

1. A method of manufacturing a cold worked product from a metallic alloy composition selected from the group consisting of an iron aluminide alloy, a nickel aluminide alloy and a titanium aluminide alloy, comprising steps of:

(a) preparing a work hardened product by cold working a metallic alloy composition to a degree sufficient to provide a surface hardened zone thereon;

(b) preparing a heat treated product by passing the work hardened product through a furnace such that the work hardened product is flash annealed for less than one minute; and optionally (c) repeating steps (a) and (b) until a cold worked product of desired size is obtained.

2. A method of manufacturing a cold worked product from a metallic alloy composition, comprising steps of:

(a) preparing a work hardened product by cold working a metallic alloy composition to a degree sufficient to provide a surface hardened zone thereon;

(b) preparing a heat treated product by passing the work hardened product through a furnace such that the work hardened product is flash annealed for less than one minute;

optionally (c) repeating steps (a) and (b) until a cold worked product of desired size is obtained; and further comprising tape casting a powder mixture of the alloy and a binder so as to form a non-densified metal sheet with a porosity of at least 30%, the non-densified metal sheet being cold worked into the work hardened product.

3. A method of manufacturing a cold worked product from a metallic alloy composition, comprising steps of:

(a) preparing a work hardened product by cold working a metallic alloy composition to a decree sufficient to provide a surface hardened zone thereon;

(b) preparing a heat treated product by passing the work hardened product through a furnace such that the work hardened product is flash annealed for less than one minute;

optionally (c) repeating steps (a) and (b) until a cold worked product of desired size is obtained; and further comprising roll compacting a powder mixture of the alloy and a binder so as to form a non-densified metal sheet with a porosity of at least 30%, the non-densified metal sheet being cold worked into the work hardened product.

4. A method of manufacturing a cold worked product from a metallic alloy composition, comprising steps of:

(a) preparing a work hardened product by cold working a metallic alloy composition to a degree sufficient to provide a surface hardened zone thereon;

(b) preparing a heat treated product by passing the work hardened product through a furnace such that the work hardened product is flash annealed for less than one minute;

optionally (c) repeating steps (a) and (b) until a cold worked product of desired size is obtained; and further comprising plasma spraying a powder of the alloy onto a substrate so as to form a non-densified metal sheet with a porosity of less than 10%, the non-densified metal sheet being cold worked into the work hardened product.

5. The method of claim 2, further comprising a step of heating the non-densified metal sheet at a temperature sufficient to remove volatile components from the non-densified metal sheet.

6. The method of claim 3, further comprising a step of heating the non-densified metal sheet at a temperature sufficient to remove volatile components from the non-densified metal sheet.

7. The method of claim 1, wherein the metallic alloy comprises an iron aluminide having, in weight %, 4.0 to 32.0% Al and $\leqq$1% Cr.

8. The method of claim 7, wherein the metallic alloy comprises a titanium aluminide alloy.

9. A method of manufacturing a cold worked product from a metallic alloy composition, comprising steps of:

(a) preparing a work hardened product by cold working a metallic alloy composition to a degree sufficient to provide a surface hardened zone thereon;

(b) preparing a heat treated product by passing the work hardened product through a furnace such that the work hardened product is flash annealed for less than one minute;

optionally (c) repeating steps (a) and (b) until a cold worked product of desired size is obtained; and the flash annealing being performed by infrared heating of the work hardened product.

10. A method of manufacturing a cold worked product from a metallic alloy composition, comprising steps of:

(a) preparing a work hardened product by cold working a metallic alloy composition to a degree sufficient to provide a surface hardened zone thereon;

(b) preparing a heat treated product by passing the work hardened product through a furnace such that the work hardened product is flash annealed for less than one minute;

optionally (c) repeating steps (a) and (b) until a cold worked product of desired size is obtained; and further comprising a step of forming the cold worked product into an electrical resistance heating element capable of heating to 900° C. in less than 1 second when a voltage up to 10 volts and up to 6 amps is passed through the heating element.

11. The method of claim 1, wherein the cold working comprises cold rolling and the work hardened product comprises a sheet, strip, rod, wire or band or the cold working comprises press forming or stamping the work hardened product into a final or intermediate shape.

12. The method of claim 1, wherein the metallic alloy comprises $Fe_3Al$, $Fe_2Al_5$, $FeAl_3$, FeAl, FeAlC, $Fe_3AlC$ or mixtures thereof.

13. A method of manufacturing a cold worked product from a metallic alloy composition, comprising steps of:

(a) preparing a work hardened product by cold working a metallic alloy composition to a degree sufficient to provide a surface hardened zone thereon;

(b) preparing a heat treated product by passing the work hardened product through a furnace such that the work hardened product is flash annealed for less than one minute;

optionally (c) repeating steps (a) and (b) until a cold worked product of desired size is obtained; and the cold working comprising cold rolling and the work hardened product comprises a cold rolled sheet, the cold rolling reducing porosity in the cold rolled sheet from over 50% to less than 10%.

14. The method of claim 1, wherein the flash annealing step comprises heating the work hardened product to a temperature of at least 400° C. for less than 45 seconds.

15. The method of claim 1, wherein the flash annealing is carried out in an air atmosphere.

16. The method of claim 1, further comprising preparing a casting of the metallic alloy and preparing a hot worked product by hot working the casting, the hot worked product being cold worked into the work hardened product.

17. The method of claim 1, further comprising annealing the cold worked product at a temperature of 1100 to 1300° C. in a vacuum or inert atmosphere.

18. The method of claim 1, further comprising a final cold working step followed by a recrystallization annealing heat treatment.

19. The method of claim 1, wherein the metallic alloy comprises an iron aluminide having, in weight %, ≦32% Al, ≦2% Mo, ≦1% Zr, ≦2% Si, ≦30% Ni, ≦10% Cr, ≦0.3% C, ≦0.5% Y, ≦0.1% B, ≦1% Nb, ≦3% W and ≦1% Ta.

20. The method of claim 1, wherein the metallic alloy comprises an iron aluminide consisting essentially of, in weight %, 20–32% Al, 0.3–0.5% Mo, 0.05–0.3% Zr, 0.01–0.5% C, ≦0.1% B, ≦1% oxide particles, balance Fe.

21. The method of claim 1, wherein the metallic alloy comprises an iron aluminide and the flash annealing step reduces hardness of the surface hardened zone by at least 10%.

22. A method of manufacturing a cold worked product from a metallic alloy composition, comprising steps of:

(a) preparing a work hardened product by cold working a metallic alloy composition to a degree sufficient to provide a surface hardened zone thereon;

(b) preparing a heat treated product by passing the work hardened product through a furnace such that the work hardened product is flash annealed for less than one minute;

optionally (c) repeating steps (a) and (b) until a cold worked product of desired size is obtained; and the cold working being carried out with rollers having carbide or non-carbide rolling surfaces in direct contact with the cold worked product.

23. The method of claim 1, wherein the cold worked product is a sheet which is produced without hot working the metallic alloy.

24. A method of manufacturing a cold worked product from a metallic alloy composition, comprising steps of:

(a) preparing a work hardened product by cold working a metallic alloy composition to a degree sufficient to provide a surface hardened zone thereon;

(b) preparing a heat treated product by passing the work hardened product through a furnace such that the work hardened product is flash annealed for less than one minute;

optionally (c) repeating steps (a) and (b) until a cold worked product of desired size is obtained; and further comprising forming the cold worked product into an electrical resistance heating element having an electrical resistivity of 80 to 400 $\mu\Omega$.cm.

* * * * *

UNITED STATES PATENT AND TRADEMARK OFFICE

CERTIFICATE OF CORRECTION

PATENT NO. : 6,143,241
DATED : November 7, 2000
INVENTOR(S) : Mohammad R. Hajaligol et al.

It is certified that error appears in the above-identified patent and that said Letters Patent is hereby corrected as shown below:

Column 1,
Line 45, delete "0.4 . 1.5" and insert therefor -- 0.4-1.5 --;

Column 4,
Line 38, delete "entiitled" and insert -- therefor -- entitled --;

Column 13,
Line 8, delete "around 34%" and insert therefor -- around 3-4% --; and
Line 65, delete "opposite thereof" and insert therefor -- opposite side thereof --.

Signed and Sealed this

Ninth Day of April, 2002

*Attest:*

*Attesting Officer*

JAMES E. ROGAN
*Director of the United States Patent and Trademark Office*